US006361228B1

(12) United States Patent
Barrus et al.

(10) Patent No.: US 6,361,228 B1
(45) Date of Patent: Mar. 26, 2002

(54) THERMAL PRINTER WITH IMPROVED RIBBON TRANSPORT

(75) Inventors: Gordon B. Barrus, San Juan Capistrano; Dennis R. White, Fountain Valley, both of CA (US)

(73) Assignee: Printronix, Inc., Irvine, CA (US)

( * ) Notice: Subject to any disclaimer, the term of this patent is extended or adjusted under 35 U.S.C. 154(b) by 0 days.

(21) Appl. No.: 09/400,387

(22) Filed: Sep. 22, 1999

Related U.S. Application Data

(60) Provisional application No. 60/136,643, filed on May 27, 1999.

(51) Int. Cl.[7] ..... B41J 33/56
(52) U.S. Cl. ..... 400/223; 400/234
(58) Field of Search ..... 400/233, 234, 400/225, 236, 236.2, 247, 248, 224, 211

(56) References Cited

U.S. PATENT DOCUMENTS 5,074,450 A 12/1991 Lindner et al.
5,342,131 A * 8/1994 Nakajima et al. ..... 400/234
5,490,638 A * 2/1996 Driftmyer et al. ..... 242/421
5,709,488 A * 1/1998 Imai et al. ..... 400/234
5,820,277 A * 10/1998 Schulte ..... 400/233
5,938,350 A * 8/1999 Colonel ..... 400/234

FOREIGN PATENT DOCUMENTS

| | | |
|---|---|---|
| EP | 0 542 270 | 5/1993 |
| JP | 04 099676 | 3/1992 |
| JP | 08 318668 | 12/1996 |
| JP | 10 100519 A | 4/1998 |

* cited by examiner

*Primary Examiner*—John S. Hilten
*Assistant Examiner*—Anthony H. Nguyen
(74) *Attorney, Agent, or Firm*—George F. Bethel

(57) ABSTRACT

A thermal printer having a source of print media, a source of print ribbon, a rotatable platen, and a print head in associated placement with the platen over which print ribbon and media pass for printing purposes. A pivotally connected ribbon support is placed before and/or after the passage of the ribbon over the print head for pivotal movement across the width of the print ribbon. The support can be a roller, and support can be combined for contact with the ribbon on surfaces opposite from each other. A drive for the print ribbon can move the print ribbon by a motor connected to the source and collecting spindle based upon the Back EMF of at least one motor.

28 Claims, 9 Drawing Sheets

THERMAL PRINTER WITH IMPROVED RIBBON TRANSPORT

This application claims the benefit of U.S. Provisional Application Serial No. 60/136,643, filed May 27, 1999 entitled a A Thermal Printer With Improved Ribbon Transport Inventors Gordon B. Barrus and Dennis R. White.

BACKGROUND OF THE INVENTION

1. Field of the Invention

This invention relates to printers which place a series of dots on underlying media to form a pattern, alpha numeric symbols, or a bar code. It relates more to those types of printers which are thermal printers wherein a print ribbon having a wax or other displaceable material thereon can be heated and disposed on an underlying media for printing thereon. Such underlying media can comprise paper, plastic, a web supporting a plurality of labels, or other media. The invention specifically relates to the print ribbon transport in a consistent manner to avoid various printing inconsistencies. Such printing inconsistencies can be light or dark print, improper alpha numeric symbols, or fuzzy printing as well as bar codes having either unclear or improper separations.

2. Description of the Prior Art

The prior art of thermal printers relied upon various brakes, clutches, supports, and other apparatus in order to provide for the proper transport of the print ribbon. The print ribbon has material thereon such as a wax or other type of heat sensitive material which can be used to imprint underlying media. The print ribbon has a very flexible and thin consistency. It borders on the fineness of a film like material of a flexible plastic sheet. Thus the print ribbon web should be maintained in a uniform and consistent position with respect to the web.

Disposed on the print ribbon is the print substance which must be disposed on underlying media. The substance of the print ribbon which is disposed under heated conditions is placed on the underlying media. It is placed at discrete points that must be accurately maintained. The accuracy is with regard to alpha numeric representations and particularly with regard to bar codes which have to be properly read.

During the process of displacement of the substance from the print ribbon, a heating element is used. The heating element can be an elongated bar having very discrete heating elements that conform to a certain number of dots per inch as desired. Such dots per inch in the way of heating elements can range up to 300 dots per inch and more.

The print ribbon when passing under the heating element or printer head and on top of an underlying media and before and after is subject to wrinkling, striations, displacement, stretching, and other distortions. This is caused by tension, inertia, and other elements in the drive systems. In the past, it has been customary to compensate for these distortions with various clutches, controls, and supports. These mechanical elements which although workable in some cases did not always provide the best results. The distortions even after passing through the printer head are propagated backwardly to the printer head.

Further complicating this matter is the fact that the underlying media that is to be printed on must be driven over a platen which is a rotatable platen formed of a hard elastomeric material against which the print ribbon is guided and heated by the heating elements of the print head. Oftentimes, the print ribbons become mis-matched with the underlying media, and distortions occur in a bar code which can be quite severe.

This invention utilizes a positive drive system for the print ribbon by a pair of D.C. brush motors that drive the take-up and supply spools. The motor velocities are measured by circuits that measure the Back EMF (BEMF) voltage of the motor drives. The movement and monitoring of the print ribbon can then be derived from the spool radius and the motor torque, as well as inertia and other dynamic aspects including the mass of the rolls on both the take-up and supply spools.

In order to maintain a print ribbon web without striations, stretched areas, or ridges and valleys, this invention incorporates a unique transport system for the ribbon. This includes spring biased rollers in order to remove ribbon distortions. Also in order to balance the edges of the ribbon a gimbaled support that can be a roller is provided.

An object of this invention is the control of the tension, movement and consistency of the print ribbon web. It is particularly important as it passes through the print head and over the underlying media that is to be printed.

A further enhancement is that the ribbon tension can be varied and maintained as to differently sized ribbon widths. The tension and movement is maintained on the print ribbon by means of rollers and a gimbaled or pivotal support.

An object of this invention avoids prior art deficiencies by lessening print ribbon wrinkle. This is enhanced by rollers, and proper support across the width of the print ribbon web.

Another object of this invention is that it provides for tensioning and uniformity across the width of the print ribbon web. When prior art mechanical devices are used to maintain tension, especially friction type devices, another mechanism needs to be added to maintain the tension. This is usually a spring wrapped around a hub. This invention removes the need for this additional mechanism.

The invention provides rollers or other surfaces mounted on springs and/or gimbals or pivots which help to remove plastic ribbon set, striations, wrinkles, and inconsistencies from the ribbon. This is accomplished by working and guiding the ribbon in two different directions as it is taken off the feed spool, and balancing support across the width of the ribbon.

The support of the ribbon across its width is enhanced by a gimbaled or pivotal support that can be a plate, rod or roller. The center pivot of the gimbal can be adjusted by a motor or manually to accommodate various widths and edge dimensions of the print ribbon.

SUMMARY OF THE INVENTION

In summation, this invention is a thermal printer and transport system having rollers which help to remove plastic print ribbon inconsistencies from the spool while maintaining tension, proper movement, transport, and a smoothing effect to the print ribbon with a gimbaled or pivotal support for accommodating support across the width of the print ribbon.

More specifically, the invention comprises a print ribbon transport system which helps to remove ribbon inconsistencies and variations. Ribbon variations are encountered due to the fineness of the print ribbon and heating that takes place at the thermal printer head. In order to remove the variations this invention utilizes a pair of rollers or other offset surfaces. The rollers specifically work the print ribbon in one direction and then the reverse direction. This reversal of direction and the working of the print ribbon irons the print ribbon in a manner so that wrinkles are diminished.

The invention further incorporates the concept of eliminating variations by working the print ribbon over a roller or another type of reverse surface. This working can be enhanced by variable spring loadings on the ribbon through leaf coil springs or other means supporting rollers or other working surfaces such as rods or plates across which the print ribbon moves.

The invention enhances the further handling of the print ribbon after and during the movement thereof through the print head process by means of another transport system. This second transport system after printing incorporates a roller or guide surface which can be gimbaled to accommodate variations across the width of the print ribbon. This gimbaled roller can be provided with any other type of surface so as to accommodate the movement of the print ribbon thereacross.

A further feature of this invention is the ability to adjust the placement of the gimbaled support with regard to its overall lateral support of the print ribbon. This is accomplished by a screw means or other adjustment means that can move the center of support of the print ribbon gimbal or gimbaled roller laterally across the print ribbon both manually and automatically.

A further enhancement of this invention is the fact that it can accommodate variously sized and variable print ribbon width by having a motorized adjustment of the support of the print ribbon after it has been printed upon. This can be done by a motorized screw system such as a lead screw and/or ball screw with a motor and a sensing system that senses the edge regions of the print ribbon.

A further feature is the adjustment of the print head pressure by a motorized movement of the print head against the platen.

As a consequence, this invention is a significant step with regard to the transport of print ribbon, the ability to diminish print ribbon variations, inconsistencies in print quality, and the ability to make adjustments of variably sized print ribbons.

DESCRIPTION OF THE PREFERRED EMBODIMENTS

Figure 9:
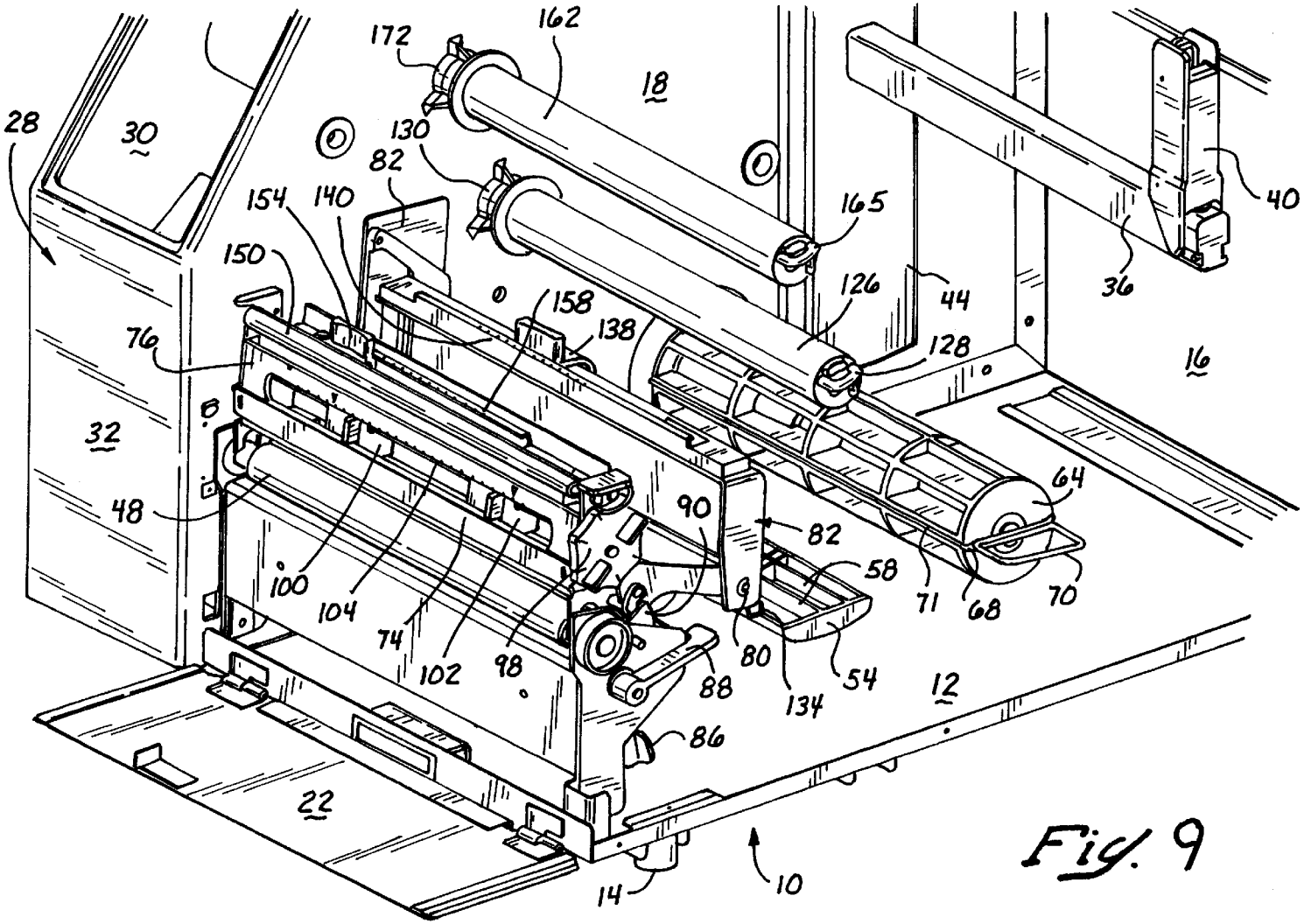
FIG. 9 shows a perspective alternative view of the transport system.
Figure 10:
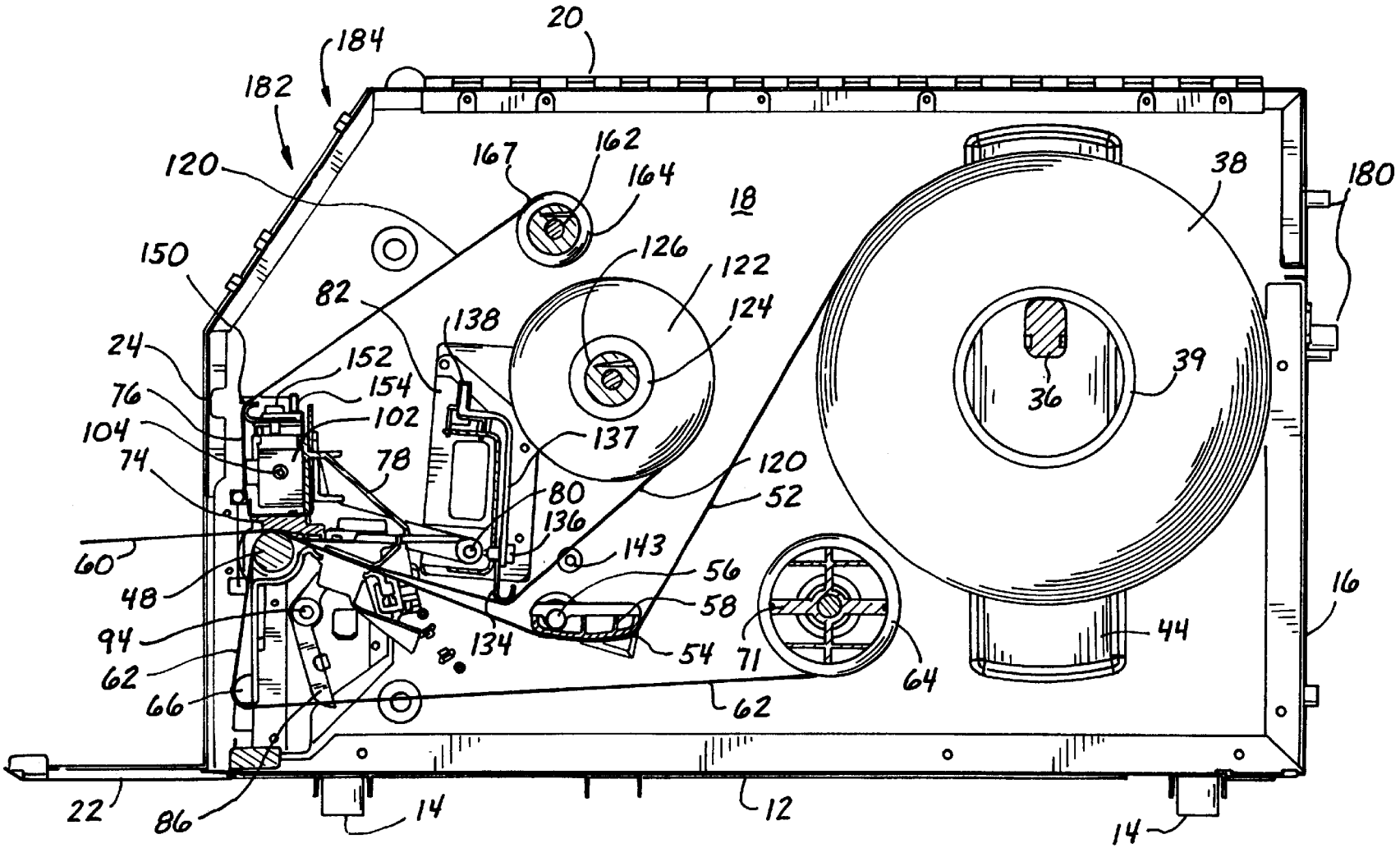
FIG. 10 shows a partially sectioned side elevation view of an alternative embodiment of the transport system of this invention.
Figure 11:
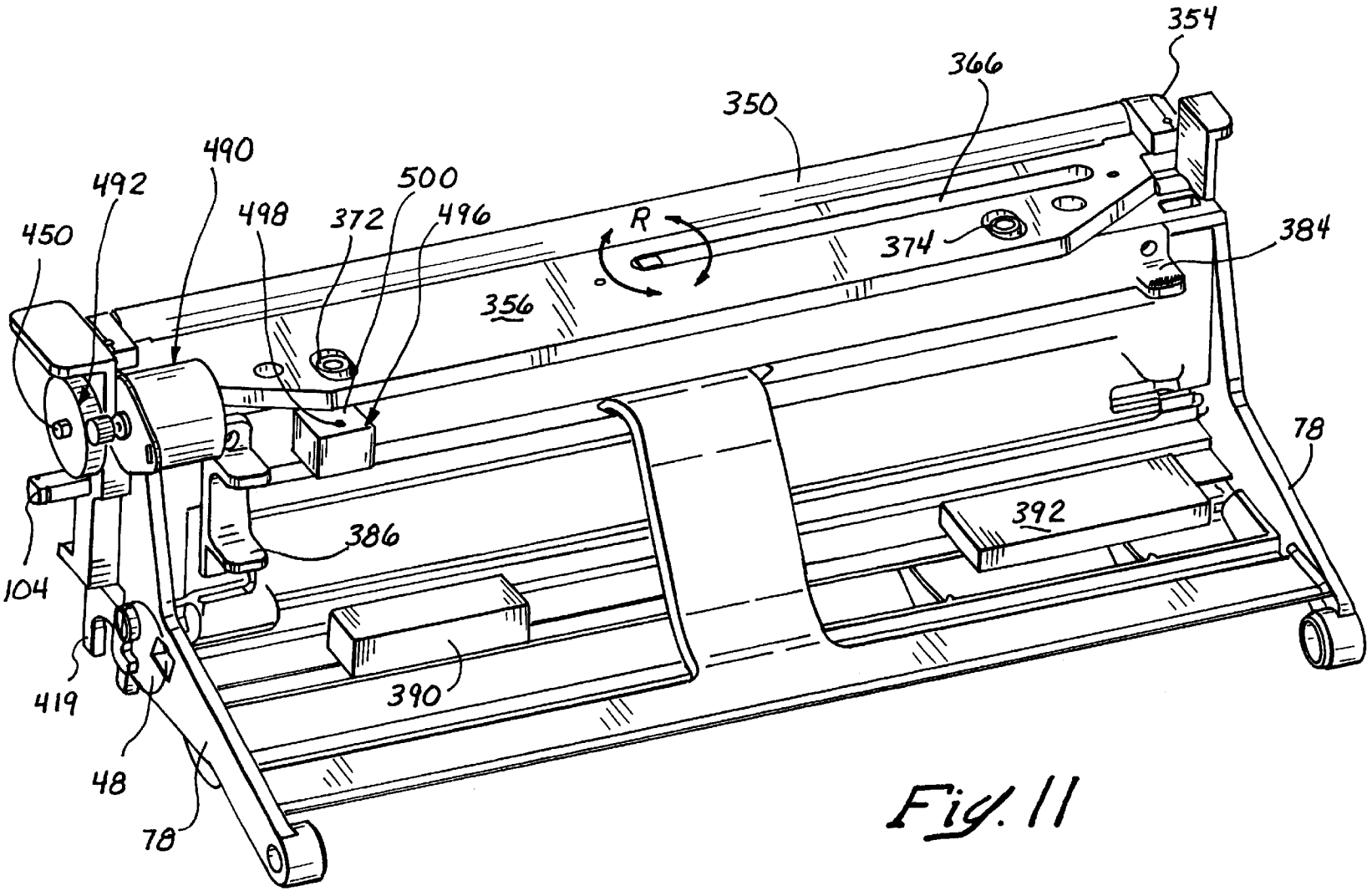
FIG. 11 shows a perspective view of the thermal print head and gimbal support and roller.

Looking more specifically at FIGS. 9 and 10, it can be seen that the thermal printer as an alternative embodiment of this invention is shown in a perspective and side elevation view. The perspective view of FIG. 9 does not have any print ribbon connected to the respective spindles nor any media on spools as in FIG. 10. FIG. 10 more aptly shows the path of the media and the print ribbon which shall be detailed hereinafter.

Looking at the apparatus of FIG. 9, it can be seen that a thermal printer 10 has been shown with a case constituting a base portion 12 having legs 14 upon which it stands. The base portion 12 forms the base for back wall 16 and cast drive support wall 18 that is in the form of a casting. The casting of wall 18 is specifically utilized because of the rigidity which is desired for the supports of the drive mechanism.

Figure 2:
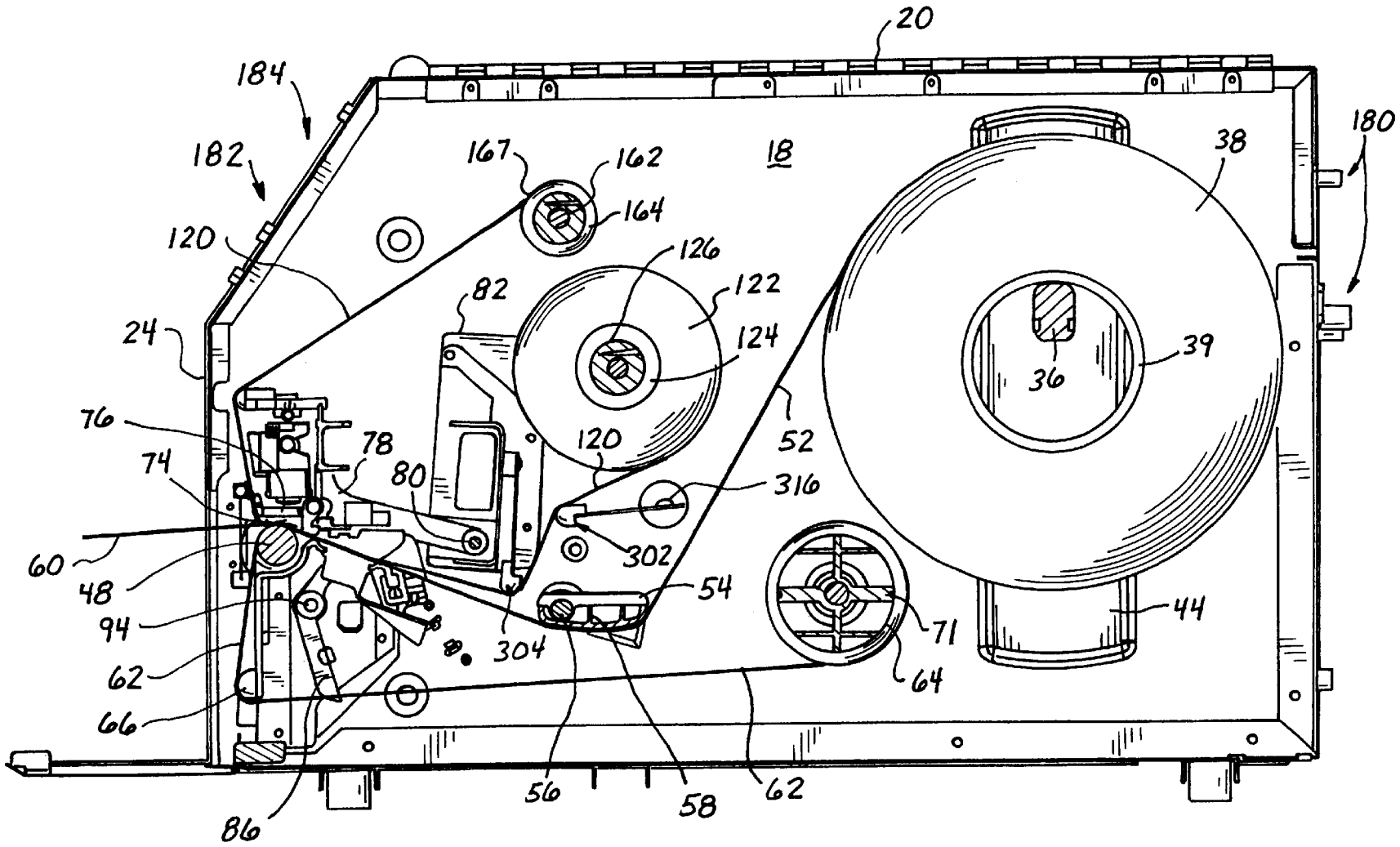
FIG. 2 is a partially sectioned side elevation view of the print ribbon path across the transport and support system as spools of the media and print ribbon itself move over the print head and then are rewound.
Figure 3:
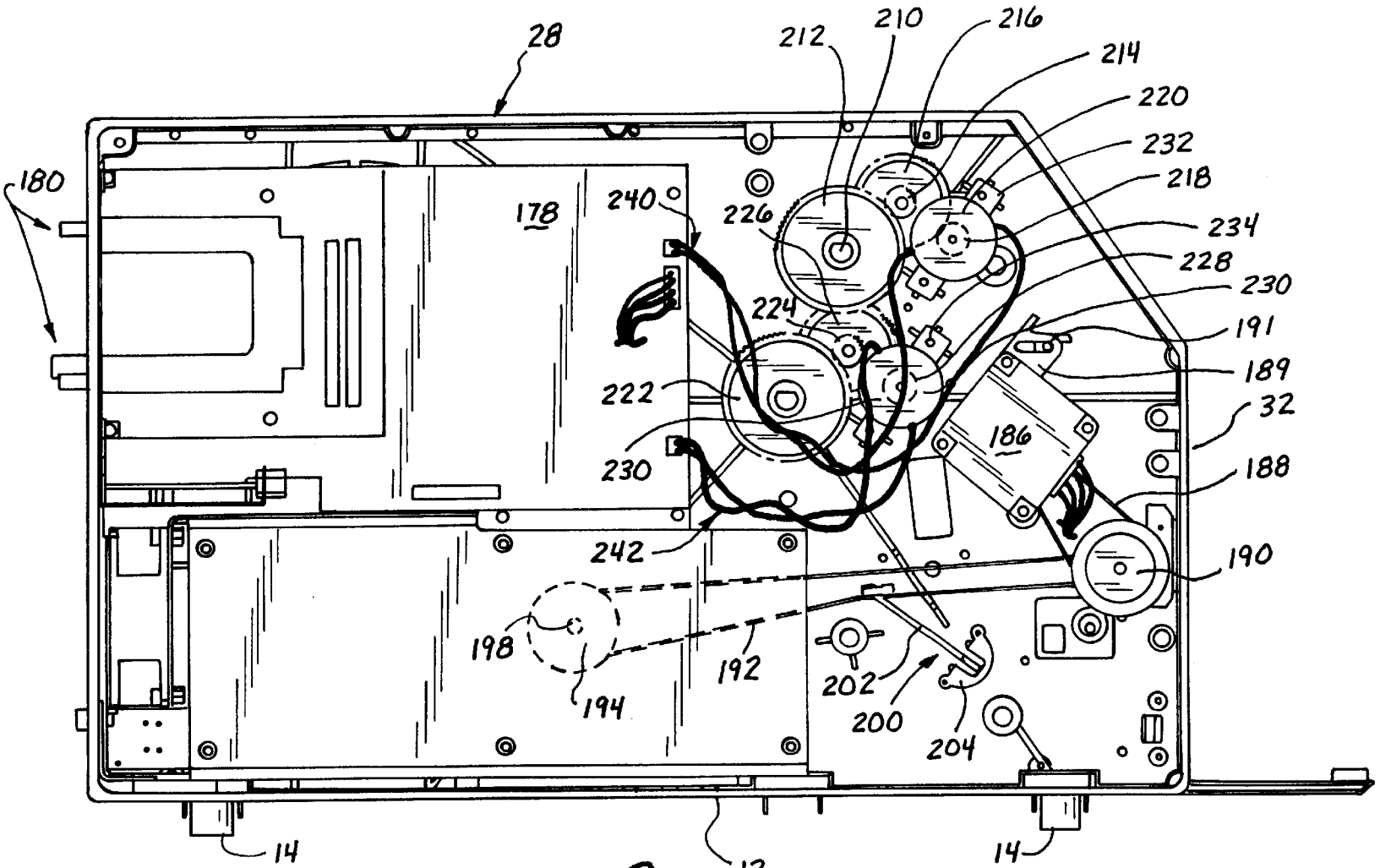
FIG. 3 shows a side elevation view of the drive system incorporating the media drive motor, D.C. motors for controlling the tension on the print ribbon as well as the gear train and electronic controls.
Figure 4:
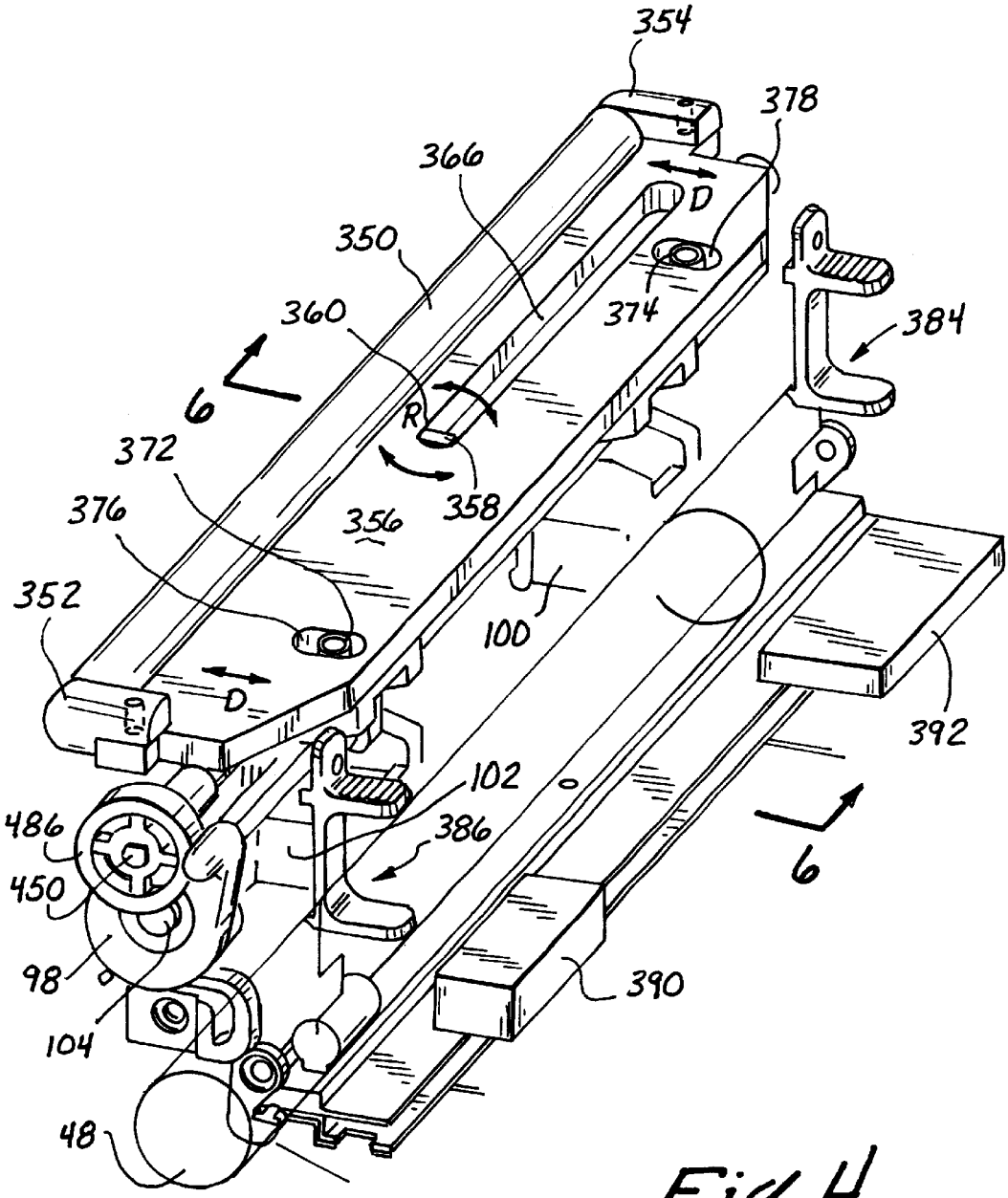
FIG. 4 shows a perspective view of the print head and platen with the transport for the print ribbon after it has moved through the printing station between the print head and the rotatable platen.

The casing is covered by a hinged lid that is not shown but wherein the hinges 20 attached to the lid are shown in FIG. 2. A frontal access door 22 and top door 24 are shown as part of the lid and covering components.

Behind the wall 18 that is formed by the casting is the control and mechanical drive for the thermal printer which are mounted therein. This is shown within a housing or casing 28 having an open portion 30 and front wall 32. The housing 28 can be of any suitable material so long as it covers and maintains the overall dust free environment and avoids contamination while at the same time protecting the gears and operators with respect to the gears.

In order to provide media to print on, a media support rod, bar or rack 36 has been provided to support a spool of media. The bar 36 is connected to the wall 18 in a rigid manner and is supported rigidly based upon the strength of the casting of the wall 18. In order to provide for media which is shown as a media roll or spool 38 on the bar 36, it is slipped over the bar. The roll or spool of media is supplied initially on a tube or cylinder 39. Afterwards a keeper 40 is placed in general alignment with the bar 36 and then moved vertically in order to lock the media roll 38 on the bar. The support of the media spool 38 is rigidified by a bossed portion 44 of the casting. The media can be a roll of paper, plastic, or tear off labels on an underlying sheet.

The media support rod 36 allows for the media to be transported by being pulled by and driven over a platen 48. The platen 48 can be a hard rigid elastomeric roller member which rotates and is driven by a drive mechanism within the casing 28. As the platen 48 rotates it pulls the media as can be seen in FIG. 2 in the form of a media strip 52 in a manner so that it is supported under tension with a pivotal foot 54.

The pivotal foot 54 is spring loaded by a coil spring on a rod 56 which allows for tensioning downwardly against the media strip 52 to keep it taut. The foot can be composed of any particular surface. In this particular case it has been shown as a convex elongated member. It has bracing ridges 58 therein in order to rigidify the foot 54 as it moves upwardly and downwardly for tensioning purposes around the axis of the pin or rod 56. This allows the media strip 52 to be held in a tightened or slightly stretched position as it passes thereunder. This is due to the spring load on the media strip 52 downwardly as it is paid off of the roll of media 38.

The media strip 52 passes toward the platen 48 and is pulled thereover by rotating the platen 48. The media strip 52 can be printed with labels. Dislodging or stripping of the labels from the media strip 52 can be provided. These labels can be seen as the end printed product 60 moving outwardly away from the platen 48 after printing. In order to retract the underlying portion of the media 62 after the labels 60 have been removed therefrom, the remaining media underlying the labels 60 is coiled around a spindle 64.

The underlying or base media 62 is initially wrapped around the spindle 64 so that it can be pulled from the platen area over a surface 66. In order to secure the underlying base media 62, a spring loaded clip 68 seated in grooves of the spindle 64 is provided. The clip 68 also has a handle 70 which can withdraw the tines of the spring loaded clip from the grooves of the spindle 64. This allows placement of the underlying base media 62 around the spindle. It is then secured by the tines 71 on either side of the spindle 64 within a groove of the spindle. Fundamentally the clip 68 is like a forked spring member having a handle 70 with tines 71 securing the media around the spindle 64.

In order to make an imprint upon the media 52, a thermal head 74 is provided spring loaded against platen 48. The thermal head 74 has a number of heating elements that can be greater than three hundred dots per inch across the width. These dots provide the dot matrix printing by heating the print ribbon. The printing head is supported on a support 76 and extends backwardly on a bracket 78 attached to a pivotal member and pin 80. This allows the thermal head 74 to be lifted off on the pivoting bracket as it pivots around the pivotal support 80. Pivotal support 80 is in turn connected to a wall bracket of wall 18 in the form of bracket 82.

The thermal head 74 is locked in place by means of a latch lever 86 connected to a tab or handle 88 having a latch hook 90 that overlies a portion of the bracket 78 in order to hold it in place. The lever 86 with the latch hook 90 can be pivoted backwardly around a pivot 94 to allow upward movement of the head 74. The head 74 is cammed for finite movement against the platen 48 by means of a lever handle 87 connected to a cam that drives the head into position over the platen.

The thermal head 74, as previously mentioned has a number of heating elements arrayed along its longitudinal length. The heating elements can number upwards of six hundred dots or more per inch. The engagement of the thermal head 74 against the platen 48 can be enhanced at the bite or intersection thereof by turning a knob 98 connected to two respective blocks 100 and 102. The head 74 floats under pressure of springs which provide the head pressure which can be adjusted as set forth.

The two respective blocks 100 and 102 have cam members therein and are driven by a shaft 104 connected to the knob 98 in order to drive the blocks 100 and 102 into tighter engagement to push the print head 74 or loosen it against the platen 48 under the spring pressure. The knob can be substituted by a motor which turns the shaft 104. The motor can be remotely controlled by logic from controller 178 or from a host for accurate positioning of the head 74 against the platen 48.

The media spool 38 provides a strip 52 over the platen 48 and under the print head 74. This is in association with a print ribbon, or film 120 delivered from a print ribbon roll or spool 122. The print ribbon roll or spool 122 is supported on a tube or cylinder such as a cardboard tube 124 and in turn is emplaced on a spindle 126. The spindle 126 receives the spool of print ribbon and is held in place by a clip 128 which expands against the tube 124 of the roll 122 and in particularly cardboard tube 124 upon which the print ribbon is rolled. The clip can be substituted by any other method of retention.

The print ribbon strip 120 can vary in width such as by a four, six or eight inch width. The media strip 52 can also be of various size widths also.

The spindle 126 is driven by a D.C. motor connected to the spindle as will be expanded upon hereinafter and is held to a wall by a journaled bracket 130. The print ribbon strip 120 passes under an elongated semi-circular plate 134 which has a rounded configuration in the alternative embodiments of this invention shown in FIGS. 9 and 10.

As seen in FIGS. 9 and 10 the plate 134 is fundamentally a pivotal gimbaled plate which can move around a pin 136 supported on a depending arm 137 as connected to a pivotal handle 138. The handle 138 is connected to the top of the bracket 82. This moves the pivot point of the gimbal plate 134 into various locations so that the print ribbon 120 passing thereover is supported across its width around a pivotal point established by pin 136. In effect, the pivotal handle 138 connected to the pin 136 is received in a slot and allows the gimbal plate 134 to pivot around the axis thereof as the print ribbon 120 in its full width passes over the gimbal plate 134.

The gimbal plate 134 can be substituted for, or supplemented with a roller over which the print ribbon passes. Also, a pair of rollers or curved surfaces on the front and back surface over which the print ribbon strip 120 passes can be utilized as in the embodiments of FIGS. 1 through 8 and 11. This helps to eliminate variations of the print ribbon as it feeds off of the spool 122. This embodiment as shown in FIGS. 1 through 8 and 11 will be detailed hereinafter.

The adjustment of the gimbal pin 136 for the gimbal element 134 with the handle 138 can be made along a given path and indexed as can be seen with index scale or marks 140. This is done by laterally moving the pivot pin 136 to a particular point for maintaining balance of the width of the print ribbon moving thereover. Furthermore, the adjustment scale or index 140 by moving the handle 138 can accommodate variously sized widths such as four, six and eight inches of print ribbon strips 120. Thus it has a dual function of maintaining the proper respective tension across the width of the print ribbon 120 as well as providing for adjustment of variously sized print ribbon from the spool 122.

The print ribbon 120 as it moves across the gimbal is then introduced and brought into contact with the media strip 52 between the print head 74 and the platen 48. The print head 74 is electrically driven by internal drivers that are included in the print head to create a degree of heated resistance for imparting selective dots of the material on the print ribbon strip 120 to the underlying media strip 52. Labels, such as labels 60 are then stripped off and allowed to be fed outwardly while the remaining portion of the media strip shown as media strip 52 is wound around the spindle 64. Spindle 64 is driven by a belt drive on the other side of wall 18 as will be expanded upon hereinafter.

After the print ribbon 120 has passed between the print head 74 and platen 48, it moves upwardly over the bracket 76 into contact with another gimbal bar 150. This gimbal bar 150 is controlled in its lateral movement in the direction of the print ribbon by means of a pin 152 attached to a handle 154. The bar 150 can be adjusted so it can accommodate the lateral movement of the print ribbon 120 web passing thereover.

This handle adjustment 154 can be seen with an index 158 that allows for the various widths of print ribbon 120 as well as adjustment of the respective ends of the bar 150. This accommodates the movement of the print ribbon strip 120. Thus, a degree of tautness and consistency of the print ribbon is maintained over the gimbal bar 150 as it is wound on a take-up roller or spindle 162.

The width of the ribbon 120 can also be accommodated by indexing of the gimbal bar 150 from the edge of the ribbon by a double screw turned manually by a shaft. This is further detailed in FIGS. 8 and 9 as described hereinafter.

The handle 154 and orientation of the gimbal bar can be substituted with a motor drive attached to a lead screw to move the center point or pin 152 from side to side as seen in the other embodiment. This motor shown in FIG. 11 and the lead screw is further detailed in FIGS. 7 and 8. This motor movement for placement of the pin 152 can be effected by remote logic from a host or controller 178. This placement can also be monitored as in FIG. 11 by a sensor for dynamic movement and stabilization of the ribbon 120 by the bar 150 to compensate for variations of the print ribbon.

The take-up roller or spindle 162 can be seen with a tube of cardboard 164 upon which the print ribbon 120 is wound in the rewind condition. The print ribbon 120 can be emplaced in any manner around the spindle 162 and secured by a clip 165 holding the cardboard tube 164 or any other retention means. As the take-up spindle 162 is rotated it develops a wound spool of used print ribbon 120 in the form of a spool 167 that is shown developing as winding is taking place.

As an aside, it is generally customary to remove the cardboard tube from the feed roll such as cardboard tube 124 and place it on the take-up spindle 162 after the roll 122 has has been fully expended. This allows for continuity and usage of the cardboard tube in developing the take-up spool 167.

The spindle 162 is supported on a journaled bracket 172 connected to the wall 18 to allow rotational movement by means of a D.C. motor as will be expanded upon hereinafter.

Looking more specifically at the opposite side of the wall 18 within the cabinet 28, it can be seen that a controller card 178 having the controls as well as the power supply and other means for controlling the thermal printer has been shown. This controller card 178 is connected by various terminals such as terminal areas 180. Terminal areas 180 connect the controller card 178 to a host such as a host computer or other control means driving and inputing the information to the memory and processor of the controller card.

The thermal printer can also utilize a control system with a pre-programmed printing memory established through an input panel. This has been shown as input panel 182 having on/off and other programmable features programmable by buttons 184. However, in most cases the thermal printer is connected for sophisticated alpha numeric output and bar codes to a host computer or controller with respect to an output to the input of the terminals 180. It should be understood that various controls and drive systems including those from a host can be utilized for the motors of this invention as well as the input to the drivers of the thermal head 74 to provide print orientation as well as variations in heat output.

Looking more particularly at the drive system of the thermal printer 10, it can be seen that a two phased stepper motor 186, which can of any other phase known to one skilled in the art has been shown. Stepper motor 186 controls and drives the platen 48 by means of a belt 188. The belt 188 can be adjusted by a tensioning means 189 which is adjusted by means of a screw setting 191 in a slot. The belt 188 is connected to a pulley or sheave drive 190. The sheave 190 drive shaft is connected to a second belt 192 which is in turn connected to a sheave or pulley 194 that connects to the underlying media strip 62 take-up spindle or roller 64. This can be accomplished by a shaft 198 passing through the sheave or pulley 194 interconnecting the roller 64 at the shaft which it is journaled on.

In order to hold the belt 192 in tension, a tensioner 200 is shown comprising a tensioner arm 202 connected to or molded with a bracket 204 which is in turn mounted to the wall 18 by screws or other fastener means. The tensioner 200 is biased for upward pressure against the belt 192, but can be used to tension it in either direction (i.e. upwardly or downwardly).

The respective shaft to the take-up spindle 162 or spool is shown as shaft 210. Shaft 210 passes through the wall 18 and is connected to the take-up spindle 162 on one end and to a gear 212 on the other end. Gear 212 is connected to a pinion 214 which is in turn connected to a gear 216 driven by a gear 218 of a D.C. motor 220.

The supply spool spindle 126 on which the print ribbon spool 122 is mounted has a common shaft with a gear 222 that is shown with the common shaft passing through to the spindle. This gear 222 interfaces with a pinion 224 that is connected to a gear 226. Gear 226 is in turn connected to a gear 228 that is connected to a D.C. motor 230.

Both motors 220 and 230 are mounted by means of brackets respectively 232 and 234. These respective brackets allow adjustment of the D.C. motors 220 and 230. The motors 220 and 230 can be brush motors or brushless motors with logic to provide analogous functions to a brush motor.

D.C. motor 220 is connected to the controller and driver 178 by means of two lines 240 while D.C. motor 230 is connected thereto by lines 242. These two respective lines 240 and 242 allow for the driving of the motors on an incremental basis. They also receive feed back therefrom as to the back EMF (BEMF) established when the motors are moving.

This BEMF is significant and substantial in the control of the motors 220 and 230. The control of the motors places tension on the print ribbon 120 as it is taken up on spindle 162 and paid out from spindle 126. Thus as spools 122 and 167 are respectively paid out and developed the torque on the spools and attendant tension of the print ribbon 120 is compensated. This allows for the desired tension and controlled movement of the print ribbon 120 as the spools 122 and 167 are respectively decreasing and increasing in their radius, mass, and relative radial velocity.

The respective inputs to the coils of the motors have been shown. These coils are in turn connected to the controller box 178. This has been previously set forth as providing the controls as well as the power and other functions necessary to run the thermal printer based upon the information input at terminals 180.

The supply spool motor 230 is connected to the print ribbon supply spindle 126 which has the spool 122 thereon. This connection is through gears 222 through 228. This gear drive with the motor 230 is used to create desired tension on the ribbon 120 in the area between the supply spool 122 and the platen 48.

Control of motors 220 and 230 for proper tension of print ribbon is through the controller noting the Back EMF (BEMF) of the motors and adjusting the motor torque based upon inertia, required torque, and velocity.

Figure 1:
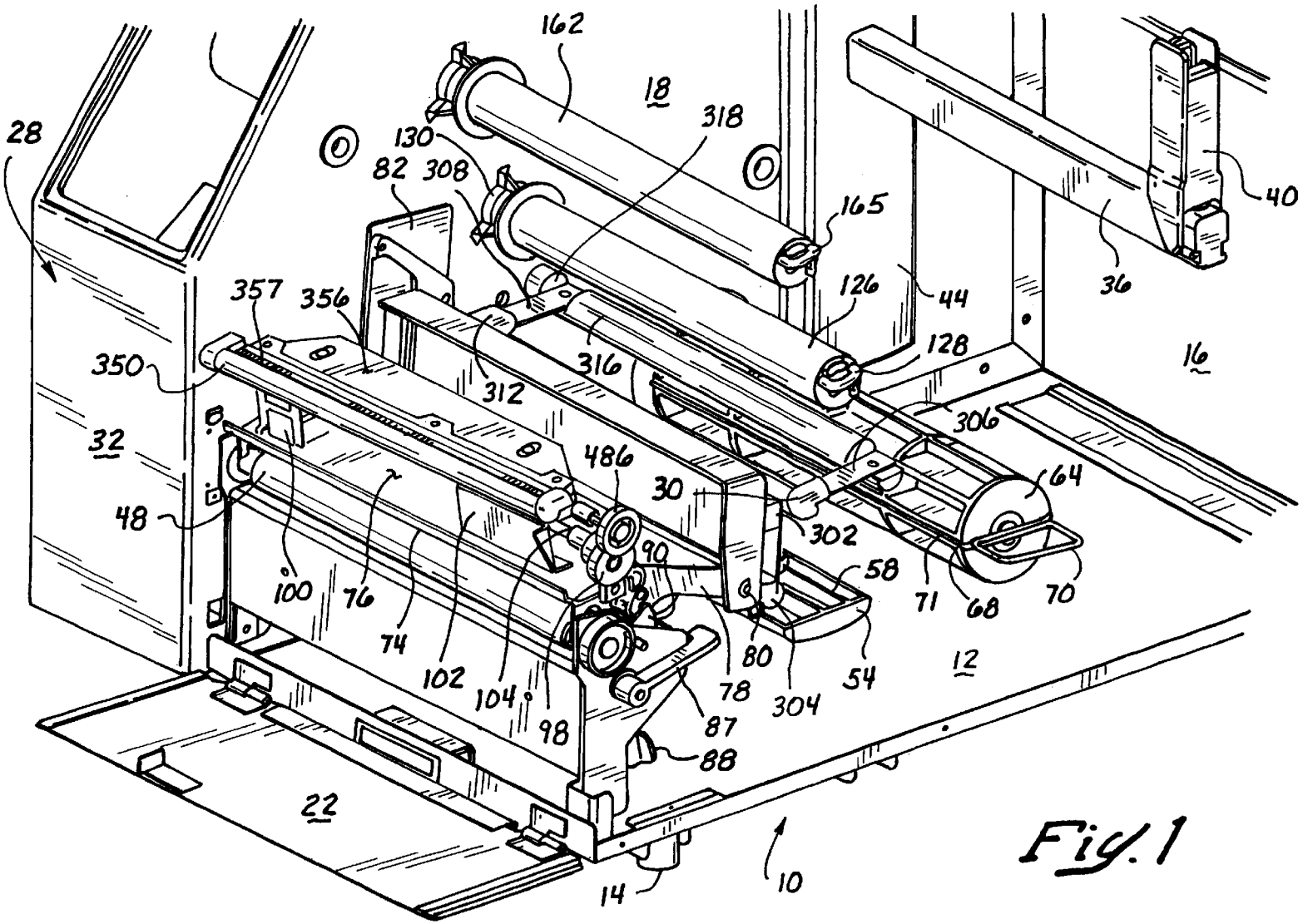
FIG. 1 shows a perspective view of the drive and take-up spools of this invention incorporated with a thermal printer head and transport system showing the rollers and gimbaled support.

Looking more particularly at FIGS. 1 and 2, it can be seen that there are substantially analogous components as far as the drive system is concerned. Also, FIG. 3 which is analogous to both embodiments shows the drive system.

FIGS. 1 through 8 and 11 are specifically directed to a transport system having rollers for removing striations, variations, and general print ribbon inconsistencies. However, as far as the drive is concerned much of the drive remains the same.

Looking more specifically at FIGS. 1 and 2, it can be seen that an initial pair of rollers 302 and 304 are shown over which the ribbon 120 passes. A single roller can also be used such as roller 302 or 304. The use of a single roller such as roller 304 can be enhanced by a surface, rod or guide plate being substituted for one of the rollers, in this case roller 302.

The rollers, 302 and 304 or guide surfaces act as self aligning guides to uniformly distribute tension over the web. In effect the self aligning guide functions both as an ironer and guide to help eliminate the various printing problems of stretching, striations, crimping, and other misalignments and inconsistencies.

Roller 302 is supported on two leaf spring members 306 and 308. The leaf springs can be substituted by other resilient members including coil springs or elastomeric cushions or shock mounts. These two spring members 306 and 308 are held in bearing housings 310 and 312. These bearing housings or journals allow the roller 302 to roll therein and can be made of a sintered bronze, plastic, ball, or roller bearing type of bearing for allowing the roller 302 to freely rotate therein. This relationship can be seen more clearly in FIG. 5.

The springs 306 and 308 are connected to a support 316 which can be varied. The support 316 in the form of a rod or arm can turn around an axis 318 for appropriate changes of the leaf spring orientation and spring constant of the leaf springs 306 and 308. In this manner, the roller 302 can apply greater or lesser pressure against the print ribbon 120 rolling thereover.

It should be understood that any type of roller 302 can be utilized in order to apply the force against the ribbon 120 as it moves thereover. Also, the movement of the ribbon 120 can be over the roller or under the roller initially and then reversed through the next roller, or over a guide plate or rod substituted for one or the other.

Figure 5:
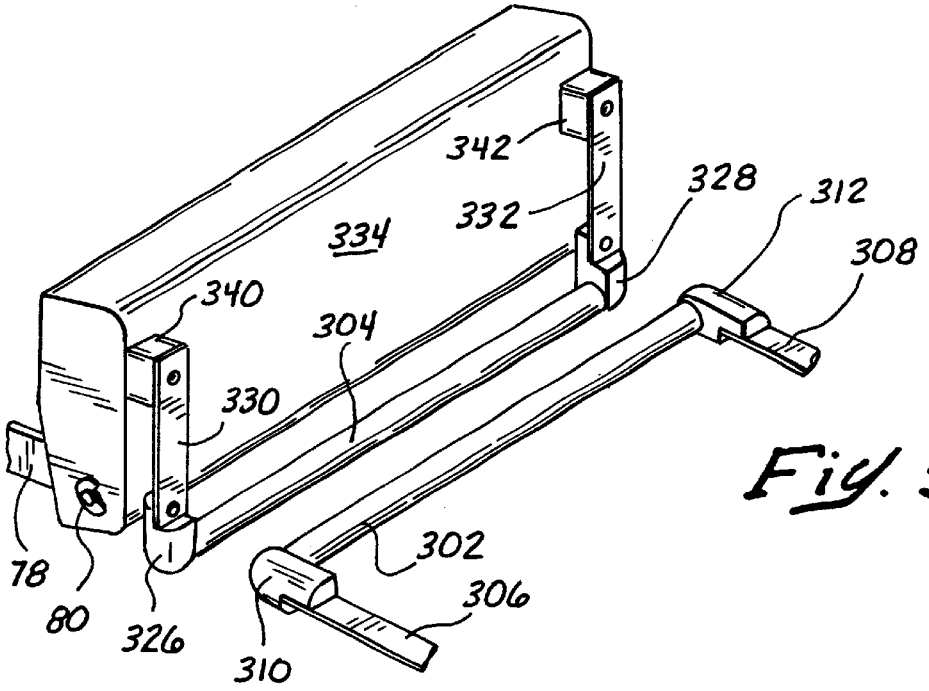
FIG. 5 shows a perspective view of the spring loaded transport system with the rollers to diminish print ribbon variations.
Figure 6:
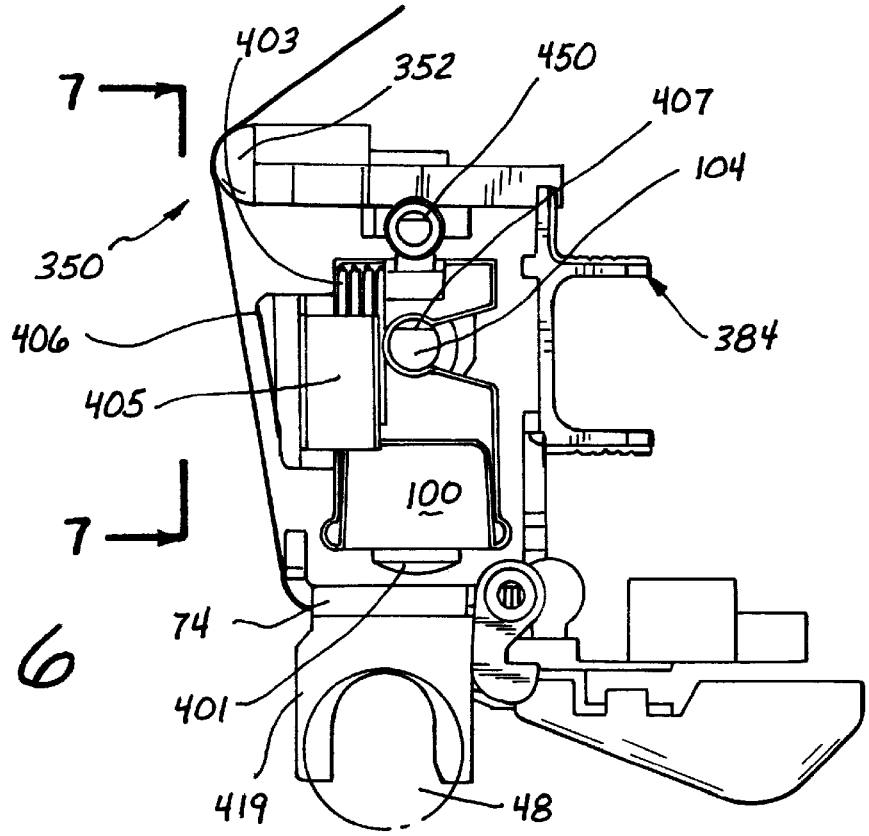
FIG. 6 shows a sectional view in the direction of lines 6—6 of FIG. 4.

Looking more particularly at FIG. 5 and the attendant showing of FIG. 2, it can be seen that the second roller 304 has been shown. This second roller 304 is particularly used in this case for the print ribbon 120 to pass under. Roller 304 is connected in like manner as roller 302 to a pair of journals or bearings 326 and 328. Here again, these journals or bearings 326 and 328 can be a sintered bronze or any other type of material which can be easily provided with a bearing surface for the roller 304.

In order to support the bearings 326 and 328 which can be ball bearings, bushings, or any other type of support for the roller 304, a pair of leaf spring like members 330 and 332 are utilized. These spring like members 330 and 332 are anchored to a plate member 334 which is in turn connected to a wall bracket 82. The springs 330 and 332 are connected by pins, or in any other suitable manner respectively to the roller 304 housings, bearings or journals 326 and 328. Also, springs 330 and 332 can have their spring constants changed by a variable mounting in the form of mounting 340 and 342. These can be hinge mountings, coil springs, or elastomeric supports to apply greater or lesser force against the print ribbon 120 as it passes over the roller 304. These can also be self aligning guides as gimbaled in the manner set forth herein.

The foregoing roller transport incorporating the rollers 302 and 304 respectively allow the passage of the print ribbon 120 over roller 302 and under roller 304. However, this orientation can be reversed depending upon the desired pull or feed technique. Another roller can be applied after roller 304 for feeding, direction or ironing appropriately to the platen 48. Suffice it to say, the rollers 302 and 304 desirably tension the print ribbon 120 between them so as to remove striations, variations, valleys, and inconsistencies across the face of the print ribbon 120 as it moves thereover and help to iron the ribbon. These rollers 302 and 304 also serve a normalizing function to the plastic underlaying material of the print ribbon 120 during the working and ironing process provided by the rollers.

As the print ribbon 120 after printing emerges from the point between the print head 74 and the platen 48, there are certain striations, inconsistencies, and wave forms that can develop and be propagated back into the print head. If these wave forms are propagated into the print head so that inconsistencies and variances across the print ribbon exist, improper printing takes place. In order to avoid this, this invention specifically has an innovative gimbaled roller 350, that acts as a self aligning guide.

The gimbaled roller 350 is supported in a set of bearing housings, journals, or bushings 352 and 354. These bearing housings are secured by means of screws or other common fastenings to a gimbal plate 356. Attached to the gimbal plate is a plurality of static removal brushes attached to a plate 357. The static removal brushes tend to trail on the print ribbon 120 as it moves over the roller 350 so as to allow for dissipation of static electricity as the print ribbon 120 is being taken up on the take-up spindle 162 developing a spool 167 of spent ribbon.

The roller or self aligning guide 350 turns within the bearing housings 352 and 354 on a free basis and can be journaled into bronze sintered metal or other types of bearing surfaces including ball bearings to allow the roller 350 to freely rotate. The roller 350 is supported on the gimbal plate 356 to allow for movement and self alignment dependent upon the particular orientation of the print ribbon passing thereover. Fundamentally the roller 350 on the gimbal plate compensates for variances across the width of the ribbon as to striations, waves and inconsistencies across the width and length.

In order to provide movement of the gimbal plate, a central pivot pin 358 is provided. Movement of the plate 356 and roller 350 can effect adjustment for various widths of print ribbon 120 so that the central support is centered for self aligning support. Central pivot pin 358 is a semi-circular sectioned pin or screw member so that the gimbal plate 356 turns on an edge 360 of the pin 358. The gimbal plate 356 rotates around the pin 358 in either direction of arrow R. This provides for the self aligning support across the web of ribbon 120.

Arrows D show the movement of the gimbal plate 356 at either end as they move backwardly and forwardly to compensate for the printer ribbon 120. The movement of the gimbal plate 356 can be adjusted by moving the pin 358 along a slot 366 so that the center reaction of the gimbal plate 356 moves in either direction to accommodate for variances in the print ribbon. The pin 358 can be of any cross-section including triangular or knife like to provide an edge upon which the gimbal plate 356 can rotate.

In order to accommodate, serve, and stabilize the gimbal plate 356 more effectively, a pair of sleeves 372 and 374 are provided within slots respectively 376 and 378. These slots 376 and 378 are provided to allow the movement of the gimbal plate 356 and are capped by means of screws or nuts thereover, the heads of which are removed.

In order to hold the print head and allow for removal, a pair of plastic handles 384 and 386 are shown having tabbed grips for holding the print head and allowing them to be squeezed for drawing the print head backwardly.

To drive the print head 74, and the other functions from the host controller 178 having the processor, a pair of terminal block connections 390 and 392 are utilized. Thus, data and electrical input can be applied appropriately through the terminal blocks 390 and 392. This includes electrical input for movement and to drive the respective heating elements to provide the dot printing functions.

For purposes of adjusting the pressure on the print head 74, a wheel 98 that can be hand driven or motor driven is connected to a shaft similar to shaft 104. Shaft 104 passes through a pair of blocks similar to blocks 100 and 102. These blocks 100 and 102 specifically have a cam therein and serve to drive upwardly and downwardly against the surface of the thermal head 74. The thermal head 74 is provided with a spring bias so that it floats on its spring support against the platen 48. This can be seen in FIG. 6 wherein block 100 with a spring plate 401 is connected to a spring internally within the blocks 100 and 102. This spring plate presses downwardly against the print head 74.

The blocks 100 and 102 can be mounted by a series of tabbed or ridged elements 403 to which a clamp 405 holding them in place is shown. The clamp 405 has a pointer 406 to show the approximate position of the blocks 100 or 102.

The block 100 is shown with the shaft 104 passing therethrough and serves through the cam surface 409 to drive the block and spring plate 401 upwardly or downwardly against the print head 74 so that it engages the platen 48. Thus, as the shaft 104 is rotated, it cams the block 100 into a tightened or loosened position with regard to the print head 74 in its floating spring supported relationship. This movement and camming is also true for block 102.

In order to position the print head 74 in overlying relationship to the shaft of the platen 48, a U shaped bracket 419 can be seen. It should be understood that as the blocks 100 and 102 move upwardly and downwardly against the print head 74, they should be in relatively good relationship to press the print head 74 downwardly or relieve spring pressure in a uniform manner across the width of the print ribbon 120. For instance, if the print ribbon 120 is a four, six, or eight inch ribbon, the respective blocks 100 and 102 should be relatively spaced to provide spring pressure of the print head 74 uniformly against the platen 48.

Looking more specifically at FIGS. 6, 7, 8, and 11, it can be seen that the gimbal plate 350 has a lead screw 450 thereunder. The lead screw 450 incorporates a series of threads 452 that have twice the distance in pitch between them as threads 454 on the same screw. The threads 452 and threads 454 cause any threaded nut device or matching surface thereon to move respectively such that travel along threads 452 is twice as great as along threads 454.

Figure 7:
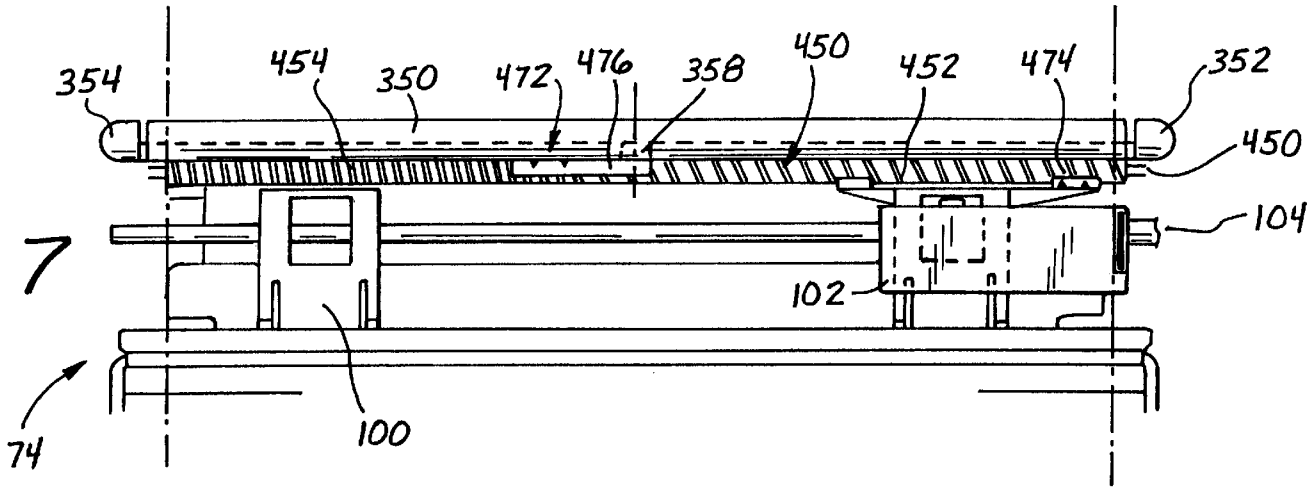
FIG. 7 shows a frontal elevation view of the lead screw and print head adjustment apparatus in the direction of lines 7—7 of FIG. 6.
Figure 8:
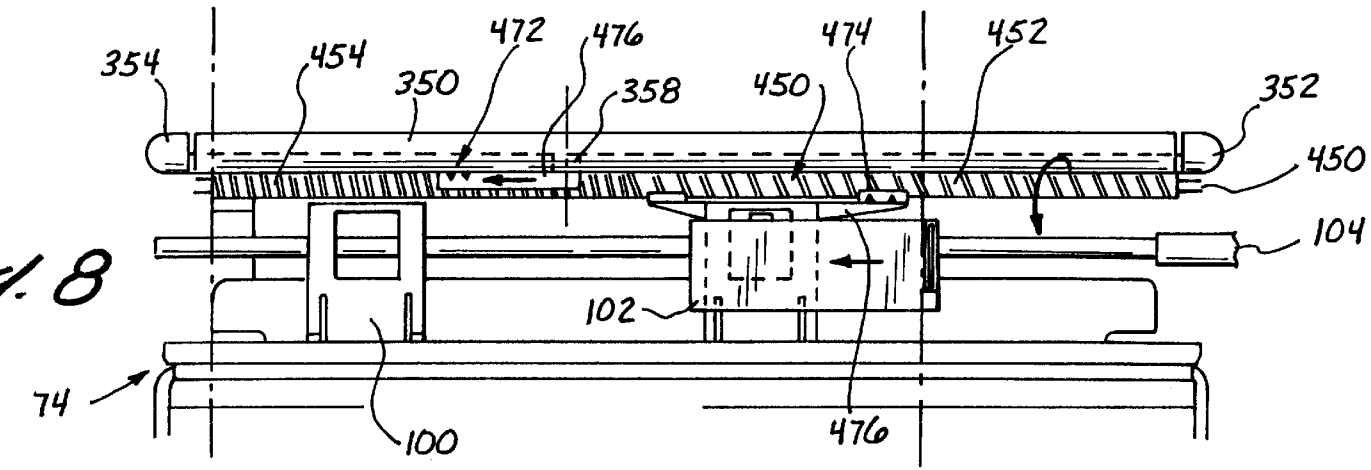
FIG. 8 shows an adjustment end movement of the print head support and width adjusting means after an adjustment for narrower width has been made from that of FIG. 7.

Inasmuch as the edge of the print ribbon 120 is to the left side as seen in FIGS. 7 and 8, the block 100 should move only half as far as the block 102 in order to accommodate for proper print head 74 pressure. In order to do this, a traveler or nut, whether it be a semi-circular nut or other type, is shown connected to each block and to the lead screw 450. For instance, block 100 has a nut like member or traveler 470 connected to the lead screw threads 454. As can be seen, phantom teeth or threads have been shown through a section in the way of teeth 472 that engage the threads 454.

Teeth 474 engage threads 452 and are on a second nut or traveler 476 connected to block 102 which provides the spring plate function of spring plate 401 downwardly against the print head 74. Here again, it is not necessary that the nuts or travelers 470 and 476 be connected to the blocks 100 and 102 respectively. However, when the lead screw 450 is turned, it serves to accommodate the placement of the blocks 100 and 102 into a uniform position if they are so connected.

The function of the dual pitched lead screw 450 is to move the block 102 as well as the gimbal pin 358 for uniform reaction of the roller 350 to the ribbon 120. This movement of the pin 358 to a centered location over the web of print ribbon 120 sets the roller into a position to provide self aligning support for the ribbon. This in turn allows the handling of striations and imperfections across the web of the ribbon 120.

Of substantially significant consideration is the fact that as the nut 470 moves to the left as seen in FIG. 8 when the lead screw is turned in the direction of the arrows, it moves the pin 358 within the slot 366 to the left. This serves to orient the edge 360 of the pin 358 against the surface of the slot 366 for proper balancing and pivoting of the gimbal plate 356 with the roller 350 thereon. In this manner, the roller 350 adjusts as to its centering and self alignment to the travel of the print ribbon 120 thereover in such a manner to compensate for printer irregularities. The index point can be taken from the edge of the ribbon 120 and the pin 358 moved into its self aligning position by manual movement or an elastomeric sensor that controls a motor to move the lead screw for pin orientation.

The gimbal plate pin 358 can be moved on the nut or traveler 470 in any suitable manner such as by the knob 486 connected to the shaft of the lead screw 450. Also, the lead screw 450 can be moved and controlled by a motor means 490 shown in FIG. 11 connected to a gear 492 which turns the shaft of the lead screw 450. Motor 490 can be controlled to move the gear 492 in either direction so that the lead screw 450 can cause the gimbal pin 358 which provides centering to move to a proper location with regard to the print ribbon 120.

As can be appreciated, the print ribbon when traveling over the roller 350 causes the self aligning movement in the direction of arrows D depending on the relative differences of the contacting ribbon 120. In order to accommodate a central location, a sensor such as an optical sensor 496 can be utilized having an optical sensing beam 498 that senses an edge or other object such as gimbal plate edge 500. The gimbal plate edge 500 can be utilized to set the gimbal plate at the properly centered location for the travel of the print ribbon 120 thereover. The positioning can also be based upon a reading of the position of the edge of the ribbon 120. In this manner variously sized ribbons can be utilized and compensated for.

As the plate 356 moves it causes variations in centering that can be compensated for. The motor 490 can drive the lead screw 450 on a dynamic basis to place the gimbal plate 356 in a centered location by moving the pin 358 along slot 366. This serves to center the edge point 360 against the slot 366 so as to effect the proper centering location of the gimbal plate 356 and roller 350 connected thereto. The net result is improved support and alignment of the print ribbon 120 as it moves over the edge of the roller 350. The dynamic drive can be controlled by a controller such as controller 178 or by a host. Here again this movement can be combined with, or controlled by indexing off of the edge of the ribbon 120 by an optical sensor.

Also, as can be appreciated the various widths of the print ribbon 120 can be accommodated by moving the lead screw 450 so as to cause the nuts or travelers 470 and 474 to move the roller 350 into a centered position. This allows for the pin 358 to be centered and then controlled dynamically to maintain the gimbal plate 356 in proper, or self alignment to provide support to the print ribbon and self alignment at the center point thereof. Here again the drive can be controlled by a controller such as controller 178, or by operator inputs from the panel 184. Also the input as to width can be controlled and derived from a host computer, or the panel 184.

As a consequence, this invention has significant bearing with regard to removing variations and inconsistencies with regard to various print ribbon configurations while at the same time supporting it at a centralized location which is a significant step over the art.

What is claimed is:

1. A thermal printer comprising:

a media support for holding media that is to be printed upon;

a spindle for holding and collecting print ribbon having dimensional variations used to print upon said media;

a print head in associated relationship with a platen over which said media and print ribbon can be moved for printing on said media;

at least one pivotal support for said print ribbon having a pivotable mounting interiorly of the edges of said print ribbon to compensate for dimensional variations before or after said print ribbon passes over said print head pivotally mounted for pivotal movement on a substantially central pivot axis of rotation; and, a drive for moving the print ribbon pivotal support with respect to its substantially central pivot axis across the width of said print ribbon to compensate for variations in the dimensional characteristics of said ribbon.

2. The thermal printer as claimed in claim 1 wherein:

said pivotal support is a roller.

3. The thermal printer as claimed in claim 1 wherein:

said pivotal support is a plate curved in cross-section.

4. The thermal printer as claimed in claim 1 wherein:

said pivotal support is spring biased against the surface of said ribbon.

5. The thermal printer as claimed in claim 1 further comprising:

said print ribbon support is both before and after the point of where said print ribbon passes over said head and in each case is a pivotally held support across the width of said ribbon.

6. The thermal printer as claimed in claim 5 wherein:

one of said print ribbon supports is a roller, and the other support is a curved plate in cross-section.

7. The thermal printer as claimed in claim 6 wherein:

one of said print ribbon supports is supported in spring biased relationship to said print ribbon.

8. The thermal printer as claimed in claim 1 further comprising:

two print ribbon supports located before the point where said ribbon passes over said print head in overlying and underlying relationship to said print ribbon; and, said pivotal support is located after where said print ribbon passes over said print head.

9. The thermal printer as claimed in claim 1 further comprising:

an electronic control for moving the pivotal center automatically with respect to the edge of said ribbon.

10. A thermal printer ribbon transport system having a thermal printer head and a platen over which printer ribbon passes and wherein said thermal printer ribbon has dimensional variations as to either length or width before or after passing over said printer head comprising:

at least one pivotally mounted support across the width of the printer ribbon before or after the passage of printer ribbon over said printer head and, which pivotal mount can be moved interiorly of the edges of said printer ribbon for rotationally pivoting at different positions for centrally balancing said support across the width of said ribbon; and, a drive for moving the gimbal support with respect to the width of said print ribbon.

11. The system as claimed in claim 10 wherein:

said pivotally mounted support is a gimbal supported curved plate.

12. The system as claimed in claim 10 wherein:

said pivotally mounted support is a gimbal supported roller.

13. The system as claimed in claim 10 further comprising:

a pivotally supported roller placed after the passage of said print ribbon beyond said head; and, at least one support over which said ribbon passes before passing over said print head.

14. The system as claimed in claim 13 further comprising:

two spring biased supports before passage of said print ribbon over said head which provide support on reverse surfaces of said ribbon.

15. A thermal printer having a source of print media, a source of print ribbon, a rotatable platen, and a print head in associated placement with said platen over which said print ribbon and media pass said print ribbon having dimensional variations before or after passing over said print head comprising:

at least one ribbon support before and after the passage of said ribbon over said print head, one of which is pivotally mounted for rotational pivotal movement oriented substantially centrally across the width of said print ribbon as said ribbon passes thereover; and, a drive connected to said ribbon support for moving said support across the width of said ribbon to compensate for dimensional variations.

16. The thermal printer as claimed in claim 15 wherein:

both of said ribbon supports are a roller.

17. The thermal printer as claimed in claim 15 further comprising:

a ribbon support combined with said pivotally mounted support before said ribbon moves across the printer head placed for contact with said ribbon on a surface of said ribbon opposite from the ribbon surface in contact with said pivotally mounted support.

18. The thermal printer as claimed in claim 15 wherein:

each of said ribbon supports is pivotally mounted for laterally displaced pivotal movement across the width of said print ribbon.

19. The thermal printer as claimed in claim 15 wherein:

one of said ribbon supports is a roller.

20. A method for thermally printing on a media comprising:

supporting and holding media for printing upon;

providing a source of print ribbon and collecting said print ribbon that has been used to print on said media;

moving said print media and said ribbon over a print head and a platen for printing thereon;

said ribbon having dimensional variations before or after said print head;

supporting said print ribbon before or after said ribbon passage over said print head on a pivotally mounted support that is caused to rotationally pivot across its axis interior to and substantially central to the width of said print ribbon to compensate for the dimensional variations of said print ribbon; and, placing the pivot point of said pivotal support by a drive which moves the pivot point to the general central area as to any dimensional variations of the print ribbon to balance the web across said print ribbon for printing purposes.

21. The method as claimed in claim 20 further comprising:

driving said print ribbon and collecting said print ribbon on respective spindles that are each driven by a motor that can generate a Back EMF and controlled by the Back EMF of at least one of said motors.

22. The method as claimed in claim 20 further comprising:

supporting said print ribbon both before and after it passes over said print head on a pivotal support that pivots with respect to the width of said print ribbon.

23. The method as claimed in claim 20 further comprising:

driving and controlling the pivotal relationship of said pivotal support by a lead screw which is driven by a motor connected to controls for controlling the position of said pivotal support by said lead screw.

24. The method as claimed in claim 20 further comprising:

controlling the placement of said pivotal support with respect to the width of said ribbon by means of a drive that is controlled from a remote location from said printer.

25. A thermal printer comprising:

a media support for holding media that is to be printed upon;

a spindle for holding and collecting print media used to print upon said media;

a print head in associated relationship with a platen overwhich said media and print ribbon can be moved for printing on said media said print ribbon having dimensional variations as to either width or length;

at least one pivotal support for said print ribbon placed before or after said print ribbon passes over said print head wherein, said support is mounted rotationally on a pivot placed interiorly distal from the edges of said print ribbon so as to allow dimensional variances of said print ribbon to be compensated for by the rotational pivoting action of said support; and, a drive for driving said pivotal support to the dimensionally balancing center of said print ribbons.

26. The thermal printer as claimed in claim 25 wherein:

said pivotal support is a roller.

27. The thermal printer as claimed in claim 25 wherein:

said pivotal mount is adjustable as to the width of the print ribbon which is to be supported to compensate for variably sized ribbon as to their width.

28. The thermal printer as claimed in claim 25 further comprising:

said pivotal support being placed both before and after the point of where said print ribbon passes over said thermal printing head, and is pivotally mounted within the central region of the print ribbon passing thereover for pivoting across the width of said print ribbon.

* * * * *